US010859962B2

(12) United States Patent
Schlumm et al.

(10) Patent No.: US 10,859,962 B2
(45) Date of Patent: Dec. 8, 2020

(54) SYSTEM FOR WIPING A PHOTOCONDUCTIVE SURFACE

(71) Applicant: HP Indigo B.V., Amstelveen (NL)

(72) Inventors: Doron Schlumm, Ness Ziona (IL); David Meshulam, Ness Ziona (IL); Yavin Atzmon, Ness Ziona (IL); Shmuel Borenstain, Ness Ziona (IL); Roy Har-Tsvi, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/465,278

(22) PCT Filed: Feb. 14, 2017

(86) PCT No.: PCT/EP2017/053261
§ 371 (c)(1),
(2) Date: May 30, 2019

(87) PCT Pub. No.: WO2018/149480
PCT Pub. Date: Aug. 23, 2018

(65) Prior Publication Data

US 2019/0391522 A1 Dec. 26, 2019

(51) Int. Cl.
*G03G 21/00* (2006.01)

(52) U.S. Cl.
CPC ..... *G03G 21/0011* (2013.01); *G03G 21/0088* (2013.01)

(58) Field of Classification Search
CPC ..... G03G 21/0011; G03G 21/0088
See application file for complete search history.

(56) References Cited

U.S. PATENT DOCUMENTS

| | | | | |
|---|---|---|---|---|
| 4,365,586 | A | 12/1982 | Hosono et al. | |
| 5,732,316 | A | 3/1998 | Yamasaki et al. | |
| 6,212,348 | B1 * | 4/2001 | Inoue | G03G 15/0812 399/284 |
| 6,223,016 | B1 | 4/2001 | Jia et al. | |
| 7,991,343 | B2 * | 8/2011 | Izawa | G03G 21/0058 15/256.51 |
| 8,086,133 | B2 | 12/2011 | Ziegelmuller et al. | |
| 2018/0024492 | A1 * | 1/2018 | Borenstain | G03G 21/0011 399/348 |

FOREIGN PATENT DOCUMENTS

| | | | |
|---|---|---|---|
| JP | H03198084 | A | 8/1991 |
| JP | 2005352310 | A | 12/2005 |
| JP | 2007011142 | | 1/2007 |
| WO | WO-2016165760 | A1 | 10/2016 |

* cited by examiner

*Primary Examiner* — Clayton E. LaBalle
*Assistant Examiner* — Michael A Harrison
(74) *Attorney, Agent, or Firm* — Dierker & Kavanaugh PC

(57) ABSTRACT

In an example, a first wiper blade is to contact the photoconductive surface and to wipe at least some of particles and fluid from the photoconductive surface and wherein a second wiper blade is to contact the photoconductive surface and to wipe at least some of the particles and fluid that have passed the first wiper blade, from the photoconductive surface. The first wiper blade includes at least one perforation forming a passage through the wiper blade to transmit part of the particles and fluid during wiping.

13 Claims, 4 Drawing Sheets

SYSTEM FOR WIPING A PHOTOCONDUCTIVE SURFACE

Liquid electrophotography (LEP) printing involves the use a printing fluid, such as of ink (liquid toner) or other printing fluid which may include small color particles suspended in a fluid (e.g. imaging oil) that can be attracted or repelled to a photoconductive surface of a photo imaging plate (PIP). In LEP printing apparatuses, a charge roller (CR) may be used to charge the photoconductive surface which is then at least partially discharged, for example by a laser, to provide for a latent image on the photoconductive surface. For each color used, the printing fluid may be provided to a respective latent image on the PIP by a binary ink developer (BID). The resulting fluid images may be transferred from the PIP onto an intermediate transfer member (ITM) for curing and may subsequently be transferred from the ITM to print media.

To maintain high print-quality, residues of ink not transferred to the ITM may be removed from the photoconductive surface of the PIP by a system having a wiper blade that wipes ink residues from the photoconductive surface.

BRIEF DESCRIPTION OF DRAWINGS

Certain examples are described in the following detailed description and in reference to the drawings, in which.

DETAILED DESCRIPTION

Figure 1:
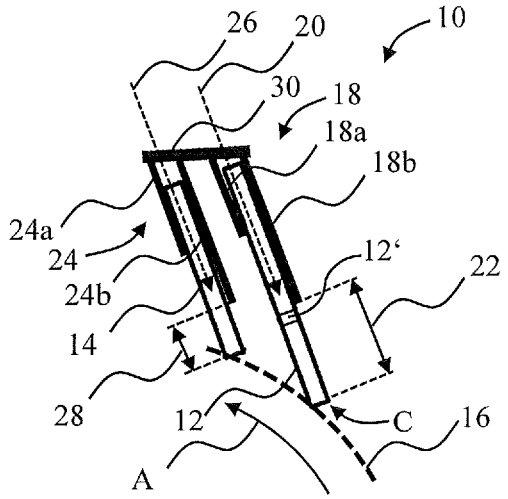
FIG. 1 shows a schematic cross-sectional view of an example of a wiping system.

In some LEP printing apparatuses, a print-quality issue sometimes referred to as "CR rings" may occur. CR (charge roller) rings may involve stripes on a print medium extending in a process direction, i.e. the direction in which the print medium is transported when being printed on, wherein the stripes have a color that is darker or brighter than intended. When CR rings occur, the printing process might have to be stopped and the PIP and possibly the CR might have to be replaced, which limits the efficiency of the printing apparatus.

The occurrence of CR rings correlates with the presence of oxidized imaging oil (IO) stripes or imaging oil rings on the PIP. Oxidized imaging oil can be caused in LEP printing apparatuses having a cleaning system with a single wiper blade by imaging oil wakes created by erosion of the single wiper blade due to impinging particles, e.g., ink-residues on the PIP after transfer of the liquid image to the ITM. The evolution of the imaging oil wake is such that at the beginning imaging oil wake dilutes the ink at the BIDs and thus creates bright stripes on the prints. Moreover, imaging oil wakes may oxidize, wherein oxidized imaging oil reduces the charging effect of the PIP by the charge roller (CR). In consequence, the PIP and possibly the CR that may have been negatively affected by the oxidized imaging oil might have to be replaced.

The lifespan of the PIP and the CR can be extended by cleaning the PIP with two wiper blades arranged one after the other in the process direction, i.e., the direction of movement of the PIP surface. In particular, downstream of an imaging oil applicator, a second wiper blade arranged after the first wiper blade in the direction of movement of the PIP surface wipes the imaging oil of the imaging oil wakes emerging from the eroded first wiper blade so that no oxidized imaging oil stripes or rings are generated, thereby maintaining charging uniformity of a photoconductive surface of the PIP. The two wiper blades can generate a uniform or smoothed distribution of imaging oil on the photoconductive surface, and can increase the lifespan of the photoconductive surface. The photoconductive surface and transfer member can be provided in different configurations, such as on a drum or belt or any other member suitable for transferring fluid images.

The photoconductive surface may have some surface irregularity. For example, if the photoconductive surface is provided on a drum, a seam may be formed at abutting edges of the surface. When the wiper blade passes over this seam or another surface irregularity, some disturbance in the wiping movement may occur. For example, the wiper blade may be bent to a greater or lesser degree than when wiping a smooth surface. In another example, the two wiper blades may be moved closer together thereby reducing the space between the two wiper blades and increasing the pressure applied to the imaging oil. Also imaging oil wakes can be caused by particles trapped under the wiper and lift the wiper so that an irregularity of the imaging oil film is generated. This can cause the level of the imaging oil between the two wiper blades to rise and/or the pressure of the imaging oil against a wiper blade to increase which, in turn, can be a cause for splashes. Splashes particular, may occur at the sides of the wiper blade with some of the imaging oil and particles being propelled sideways out of the gap between the two wiper blades. This can contaminate the LEP printing apparatus. To avoid splashes during wiping, the first wiper blade may include at least one perforation extending in the direction of relative movement between the wiper and the photoconductive surface, the perforation forming at least one passage through the first wiper blade. The at least one passage provides a runaway path for the momentarily high pressure oil.

As explained below in further detail, in an example, an applicator sponge for applying imaging oil to the photoconductive surface can be provided upstream of the wiper blades wherein the wiper blades wipe across the photoconductive surface downstream of the applicator sponge to remove contaminants and generate a defined-thickness even imaging oil film on the photoconductive surface. Excess fluid can be directed through the passage or passages in the first wiper blade to the applicator sponge which can collect and feedback the collected imaging oil.

FIG. 1 shows a schematic cross-sectional view of an example of a wiping system 10. The wiping system 10 of this example comprises a first wiper blade 12 and a second wiper blade 14. The first wiper blade 12 is arranged to contact a photoconductive surface 16 of a PIP (photo imaging plate) 38 to wipe at least some of the particles and excess fluid from the photoconductive surface 16. The second wiper blade 14 is arranged at a predetermined distance from the first wiper blade 12, in a moving direction of the photoconductive surface 16 downstream of the first wiper blade 12, indicated by the arrow A in FIG. 1. Like the first wiper blade 12, the second wiper 14 blade is arranged to contact the photoconductive surface 16 of the PIP 38 and to wipe at least some of the particles and excess fluid that have passed the first wiper blade 12, from the photoconductive surface 16. As described below, in an example, the first and second wiper blades 12, 14 are adjusted to apply a defined pressure to the photoconductive surface to create a thin uniform film of imaging oil on the photoconductive surface 16. The film thickness and hence the amount of imaging oil which passes under the wiper blades will depend on the pressure applied by the wiper blades 12, 14. Further, the two wiper blades can clean the photoconductive surface 16 from particles.

The first wiper blade 12 is attached to a first holder part 18 comprising a first arm 18*a* and a second arm 18*b* which sandwich the first wiper blade 12, wherein the first arm 18*a* and the second arm 18*b* may have different lengths as shown in FIG. 1. The first holder part 18 may be coupled to an attachment portion (not shown) for mounting the first holder part 18 in a predetermined position relative to the photoconductive surface 16. When mounted, a length direction 20 of the first wiper blade 12, i.e., a direction in which the first wiper blade 12 extends along one of its axes, may be oriented or inclined towards the photoconductive surface 16 and a width direction of the first wiper blade 12, orthogonal to the length direction 20, may be oriented in parallel to the photoconductive surface 16 (or parallel to a tangent plane of the photoconductive surface 16 if the photoconductive surface 16 is curved). The lengths of the wiper blades 12, 14 can be designed to have a defined force applied to the photoconductive surface to achieve a desired imaging oil film thickness.

A length of a free portion 22 of the first wiper blade 12, i.e. a portion of the first wiper blade 12 extending beyond the first arm 18*a* and the second arm 18*b* in the length direction 20 may be designed to be larger than a space between the photoconductive surface 16 and the first holder part 18. As a result, the free portion 22 of the first wiper blade 12 may be forced to flex away from the surface of the PIP 38 to fit the space. More particularly, the length of the first wiper blade 12 in the length direction 20 of the first wiper blade 12 (in an unbend state) may be chosen to force the free portion 22 of the first wiper blade 12 to bend away from the photoconductive surface 16 when the first holder part 18 is mounted relative to the photoconductive surface 16. The resulting bent or deflection may be designed to produce a desired pressing force when the first holder part 18 is mounted in the apparatus 32 of FIG. 2. As a result, the resilience of the first wiper blade 12 presses a front edge or wiping edge of the free portion 22 of the first wiper blade 12 against the photoconductive surface 16.

Given a predetermined distance between a mounting position of the first holder part 18 and the photoconductive surface 16, the length of the second arm 18*b* in the length direction 20 of the first wiper blade 12 may be chosen to achieve a first predetermined pressing force between the front edge of the first wiper blade 12 and the photoconductive surface 16. For example, the first predetermined pressing force may be determined as a function of the elasticity of a chosen material of the first wiper blade 12 and a chosen length and thickness of the free portion 22.

The second wiper blade 14 is attached to a second holder part 24 having a first arm 24*a* and a second arm 24*b* which sandwich the second wiper blade 14, wherein the first arm 24*a* and the second arm 24*b* may have different lengths as shown in FIG. 1. The second holder part 24 may be coupled to the attachment portion (not shown) for mounting the second holder part 24 in a predetermined position relative to the photoconductive surface 16. When mounted, a length direction 26 of the second wiper blade 14, i.e., a direction in which the second wiper blade 14 extends along one of its axes, may be directed towards the photoconductive surface 16 and a width direction of the second wiper blade 14 which is orthogonal to the length direction 26 may be parallel to the photoconductive surface 16.

A length of a free portion 28 of the second wiper blade 14, i.e. a portion of the second wiper blade 14 extending beyond the first arm 24*a* and the second arm 24*b* in the length direction 26, e.g. parallel to an edge of the second wiper blade 14 when the second wiper blade 14 is in an unbend state, may be designed to be larger than a space between the photoconductive surface 16 and the second holder part 24. As a result, the free portion 28 of the second wiper blade 14 may be forced to flex away from the surface of the PIP 38 to fit the space. More particularly, the length of the second wiper blade 14 in the length direction 26 of the second wiper blade 14 (in an unbend state) may be chosen to force the free portion 28 of the second wiper blade 14 to bend away from the photoconductive surface 16 when the second holder part 24 is mounted relative to the photoconductive surface 16. The resulting bend or deflection may be designed to produce the desired pressing force when the second holder part 24 is mounted e.g. to the apparatus 32 of FIG. 2. As a result, the resilience of the second wiper blade 14 would press the front edge or wiping edge of the free portion 28 of the second wiper blade 14 against the photoconductive surface 16.

Given a predetermined distance between a mounting position of the second holder part 24 and the photoconductive surface 16, the length of the second arm 24*b* in the length direction 26 of the second wiper blade 14 may be chosen to achieve a second predetermined pressing force between a surface of the second wiper blade 14 and the photoconductive surface 16. For example, the second predetermined pressing force may be determined as a function of the elasticity of a chosen material of the second wiper blade 14 and a chosen length and thickness of the free portion 28. For example, the first wiper blade 12 and the second wiper blade 14 may be made of a same material and have the same thickness and the same or different lengths of the free portions 22 and 28 to achieve the same or different first and second predetermined pressing forces.

In an example, the pressing force between the first wiper blade 12 and the photoconductive surface 16 can be in a range of 20 N/m to 50 N/m and the pressing force between the second wiper blade 14 and the photoconductive surface 16 can be in a range of 50 N/m to 200 N/m. Furthermore, the first wiper blade 12 and the second wiper blade 14 can be made of polyurethane foam, polyethylene foam, or another thermoplastic foam, or another suitable material with a shore A hardness in a range of 70 to 80. Moreover, a thickness of the first wiper blade 12 and a thickness of the second wiper blade 14 can be in a range of 2 to 4 millimeters and can be identical. Having the first wiper blade 12 and the second wiper blade 14 with similar dimensions may increase production efficiency.

The free length of the first wiper blade 12, i.e., the length of the portion 22 of the first wiper blade 12 extending from the second arm 18*b*, can be in a range of 10 to 13 millimeters and the free length of the second wiper blade 14, i.e., the length of the portion 28 of the second wiper blade 14 extending from the second arm 24*b*, can be in a range of 5 to 7 millimeters wherein the second predetermined pressing force can be higher than the first predetermined pressing force, e.g., by a factor greater than 2 or in a range of 2 to 10.

Making the second pressing force applied by the second wiper blade 14 higher than the first pressing force may reduce the risk of scratches in the photoconductive surface 16 due to the lower pressing force of the first wiper blade 12, while the higher pressing force of the second wiper blade 14 may safely wipe particles and excess fluid which passes the first wiper blade 12. In another example, the pressure between the wiping edge of the first wiper blade 12 and the photoconductive surface 16 may be above 100,000 $N/m^2$ and the pressure the wiping edge of the second wiper blade 14 and the photoconductive surface 16 may be above 100,000 $N/m^2$ and for example above 1,000,000 $N/m^2$ and below 10,000,000 $N/m^2$.

An angle between the length direction 20 of the first wiper blade 12 and the length direction 26 of the second wiper blade 14 may be less than 60° or less than 30°. In the example shown in FIG. 1, the length direction 20 of the first wiper blade 12 and the length direction 26 of the second wiper blade 14 may be parallel to achieve a small form factor. An angle between the length direction 20 of the first wiper blade 12 and a tangent to the photoconductive surface 16 at a contact line C between the first wiper blade 12 and the photoconductive surface 16, the tangent being orthogonal to the width direction of the first wiper blade 12, may be about 26° or in a range of 10° to 45°. An angle between the length direction 26 of the second wiper blade 14 and a tangent to the photoconductive surface 16 at a contact line between the second wiper blade 14 and the photoconductive surface 16, the tangent being orthogonal to a width direction of the second wiper blade 14, may be about 29° or in a range of 10° to 45°. The contact angle and the pressure applied by the wiper blades determine the amount of fluid which can pass under the wiper blades.

The width of the first wiper blade 12, measured along the contact line C between the first wiper blade 12 and the photoconductive surface 16, may be above 30 millimeters, 100 millimeters, 300 millimeters, 500 millimeters or above 700 millimeters, and further may be below 2000 mm, 1500 millimeters or below 1000 millimeters, depending on the width of the photoconductive surface 16 to be cleaned. The width of the second wiper blade 14, measured along the contact line between the first wiper blade 12 and the photoconductive surface 16, may be above 30 millimeters, 100 millimeters, 300 millimeters, 500 millimeters or above 700 millimeters, and below 2000 mm, 1500 millimeters or below 1000 millimeters. In an example, the width of the first wiper blade 12 and the width of the second wiper blade 14 do not differ by more than 10 millimeters or are identical. In another example, the width of the first wiper blade 12 and the width of the second wiper blade 14 are wider than a width of the photoconductive surface 16. The height H of the wiper blades 12, 14 may be in the range of 20 mm to 30 mm, for example.

In this example, the first wiper blade 12 is configured to have at least one perforation 12' forming a passage through the first wiper blade. More specifically, the first wiper blade 12 may include a number of perforations 12' forming a number of passages distributed along the width of the first wiper blade 12, the width of the first wiper blade extending parallel to a contact line C between the first wiper blade 12 and the photoconductive surface 16.

FIGS. 3A to 3F show schematic elevational views of different examples of wiper blades 60, 70, 80, 90, 100, 110. These examples can be used as the first wiper blade 12 and also as the second wiper blade 14.

Figure 3A:
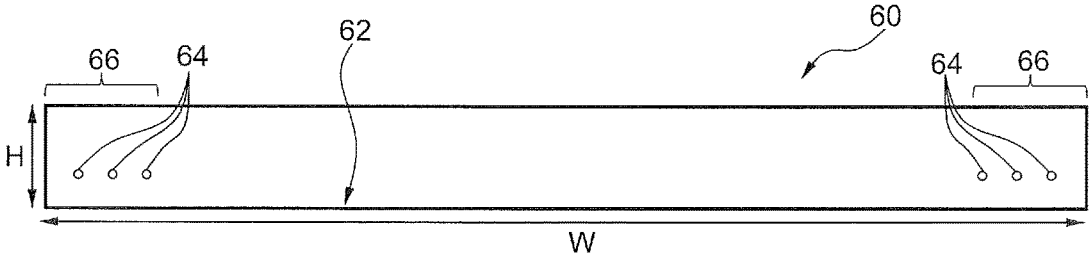
FIG. 3A to 3F show schematic elevational views of different examples of wiper blades.

In the example of FIG. 3A, the wiper blade 60 has a general rectangular shape, including a height H and a width W, the width W extending along the contact line C between a wiping edge 62 of the wiper blade 60 and the photoconductive surface 16. Three perforations 64 are formed along the line parallel to the wiping edge 62, at both side edge regions 66 of the wiper blades 60. The perforations 64 have circular cross-sections and extend through the thickness of the wiper blades 60 (perpendicular to the drawing plane) to form passages through the wiper blades 60, the passages extending in the direction of relative movement between the wiper blade 60 and the photoconductive surface 16 providing a runaway path for imaging oil. The perforations 64 are spaced from the wiping edge 62 by a predetermined distance, measured from the wiping edge to the center of each perforation 64, such as about 5 mm to 15 mm, or about 8 mm to 13 mm, or about 10 mm, 11 mm or 12 mm. In absolute terms the side edge regions, on both sides of the wiper blade, may extend along a width of about 20 mm to 100 mm or about 30 mm to 60 mm, for example. The diameter of the circular perforations, in this example, is about 2 mm to 8 mm, or about 4 mm to 6 mm, or about 4 mm, 5 mm, or 6 mm. The outermost perforations 64 are spaced from the side edges of the wiper blades 60 at a distance of about 5 mm to 20 mm, or about 8 mm to 15 mm, or about 10 mm, or 15 mm. The three perforations, in this example, are arranged at a pitch of about 5 mm to 20 mm, or about 8 mm to 15 mm, or about 10 mm, or about 15 mm.

The number of perforations, their size, shape and relative arrangement will depend on the size of the wiper and the overall design and expected performance of the wiping system. The values given above and in the following are examples, without limitation of this disclosure to the specific values. Circular cross-section perforations are easy to manufacture but there is no need for this particular cross section. In different examples, the size and number of perforations is chosen such that the stiffness of the wiper blade is not or not significantly affected and that the desired thickness of the imaging oil film is maintained.

Figure 3B:
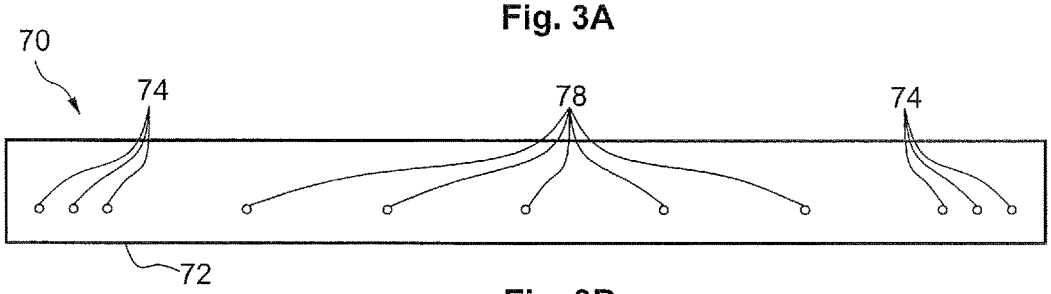

In another example, shown in FIG. 3B, the wiper blade 70 is generally designed as in FIG. 3A, except that additional perforations 78 are provided between side edge region perforations 74. In the example of FIG. 3B, there are five additional perforations 78, which are equally spaced between the side edge perforations 74, along the width of the wiper blade 70. In this example, the additional perforations 78, in a center region of wiper blade, have the same circular cross-section as the side edge perforations 74 which, in turn, may be dimensioned as described above with regard to the side edge perforations 64. The side edge perforations 74 and the additional perforations 78 are spaced from the wiping edge 72 of the wiper blade 70 wherein the distance to the wiping edge 72 and to the side edges of the wiper blade 70 may be as described above with regard to perforations 64.

Figure 3C:
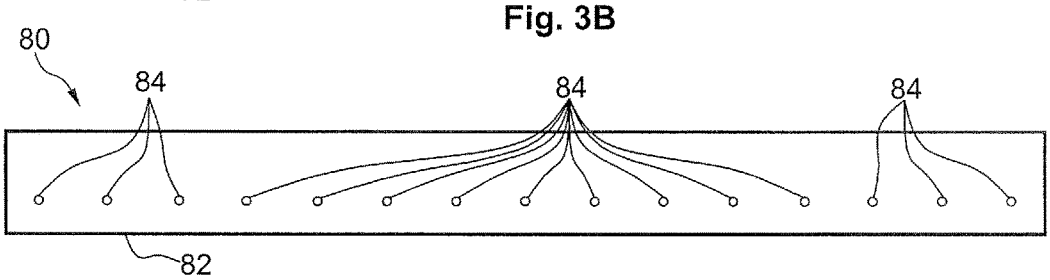

In another example, shown in FIG. 3C, the wiper blade 80 is generally designed as in FIGS. 3A and 3B, except a plurality of perforations 84 are arranged at equal spacing along the width of the wiper blade 80. The width and the height of wiper blade 80 may be the same as in FIGS. 3A and 3B, or different therefrom. The perforations 84 may have the same circular cross-section as the perforations 64. The perforations 84 are spaced from the wiping edge 82 of the wiper blade 80 wherein the distance to the wiping edge 82 and to the side edges of the wiper blade 80 may be as described above with regard to perforations 64. The exact number and spacing of the perforations can be spacing of the perforations can be adapted according to the design of the printer. For example, there can be any number between two and 200 perforations distributed along the width of the wiper blade In further variants of any of the examples of FIGS. 3A, 3B, and 3C, the perforations may have different shapes, sizes and spacing; and perforations having different shapes, sizes and spacing may be provided within one same wiper blade 60, 70, and 80. Further, depending on the total width of the wiper blade and the application, also the total number of perforations may vary. Perforations can have any shape, including an oval or rectangular cross section and perforations having a round, oval and/or rectangular cross section may be combined within the same wiper blade.

Figure 3D:
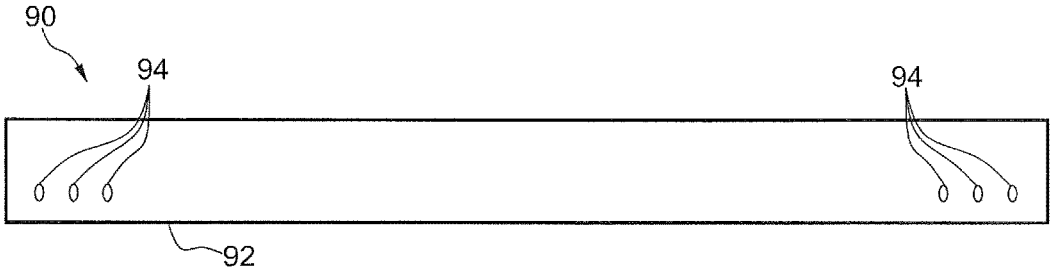
Figure 3E:
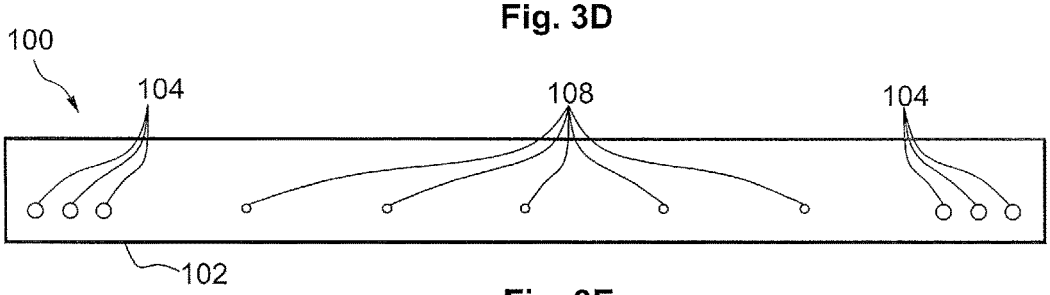
Figure 3F:
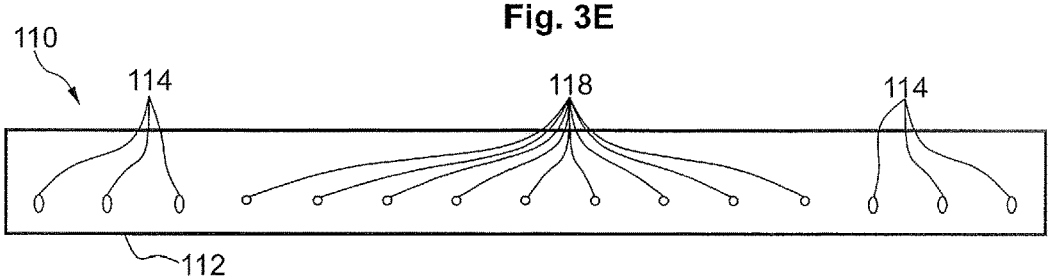

For example, FIG. 3D shows a variant of the example of FIG. 3A in which a wiper blade 90 comprises side edge perforations 94 having an oval shape. FIG. 3E shows a variant of the example of FIG. 3B in which a wiper blade 100 comprises the side edge perforations 104 having a larger diameter than center perforations 108. FIG. 3F shows a further variant of a wiper blade 110 in which side edge perforations 114 having an oval cross-section and center perforations 118 having a circular cross-section are combined. In the examples of FIGS. 3D to 3F, dimensions and spacing of the wiper blades and perforations can be as described above with regard to FIGS. 3A to 3C or different therefrom. The figures show a limited number of examples, and different arrangements and combinations of perforations of different size and shape can be provided.

In at least some examples, the density of the perforations in the two side edge regions, e.g. 66, of the first wiper blade, e.g. 60, 70, 90, 100, 110, is higher than in a middle region of the first wiper blade wherein a side edge region is defined to be adjacent an end of the contact line C and the middle region is defined to be in the middle between the two ends of the contact line C. For example, one, two, three, four or five perforations are provided in each side edge region of the first wiper blade and no perforations are provided in the middle region of the first wiper blade. In another example, one, two, three, four or five perforations are provided in each side edge region of the first wiper blade and a second number of perforations are provided in the middle region of the first wiper blade, the second number of perforations depending on the width of the middle region. In this example or in a further example, the density of the perforations in the two side edge regions can be higher than the density of the second number of perforations in the middle region of the first wiper blade.

In the above example or in a further example, the side edge regions of the first wiper blade may extend along about 2% to about 15%, or along about 5% to about 10% of the width of the first wiper blade, on both sides of the wiper blade.

In the above or further examples, the at least one perforation can have a circular, oval or rectangular cross section. Further, the at least one perforation can be spaced from a front edge of the first wiper blade by a distance which is between one time the diameter of the perforation to about four times the diameter of the perforation, or from about 1.5 times the diameter of the perforation to about 2.5 times the diameter of the perforation.

The above should be understood as examples wherein absolute values will depend on the overall size of the photoconductive surface to be cleaned, of the wiping system, of the wiper blade and the like. When an approximate value is given, this value should be understood to also include the respective exact value.

By adjusting the spacing of the perforations 64, 74, 48, 84, 94, 104, 108, 14, 118 from the wiping edge 62, 72, 82, 92, 102 and 112, it is possible to control passing of the imaging oil and particles through the passages provided by the perforations. If the spacing is small, during wiping, imaging oil will begin to pass through the passages even at a respective low level of the imaging oil; whereas, a larger spacing will have the effect that imaging oil passes through the passages at a corresponding higher level of the imaging oil. Accordingly, the spacing between the perforations and the wiping edge can be used to manipulate the dynamics of the imaging oil during wiping and to avoid splashing. As indicated above, in different examples, the size and number of perforations is chosen such that the stiffness of the wiper blade is not or not significantly affected and that the desired thickness of the imaging oil film is maintained.

In one of the above or a further example, also the second wiper blade may include at least one perforation forming a passage through the second wiper blade said passage being at least partially blocked when the second wiper blade is mounted in the system. In a variant of this example, the second wiper blade may be configured in a way identical or substantially identical to the first wiper blade wherein the passages of the second wiper blade are at least partially blocked. In particular, the passages may be blocked by the wiper holder supporting the first and second wiper blades. This is described further below with reference to FIGS. 4 and 5.

As shown in FIG. 1, the holder part of the first wiper blade 12 and the holder part of the second wiper blade 14 may be formed integrally as one part thereby forming a double wiper support structure 30 that comprises the first holder part 18 and the second holder part 24. Furthermore, the double wiper support structure 30 may comprise the attachment portion (not shown) for mounting the double wiper support structure 30 relative to the photoconductive surface 16. In an example, the attachment portion may have an adapter that is substantially identical to corresponding adapters of single wiper support structures so that the double wiper support structure 30 can be inserted into the same fitting as used for mounting a single wiper support structure.

Figure 2:
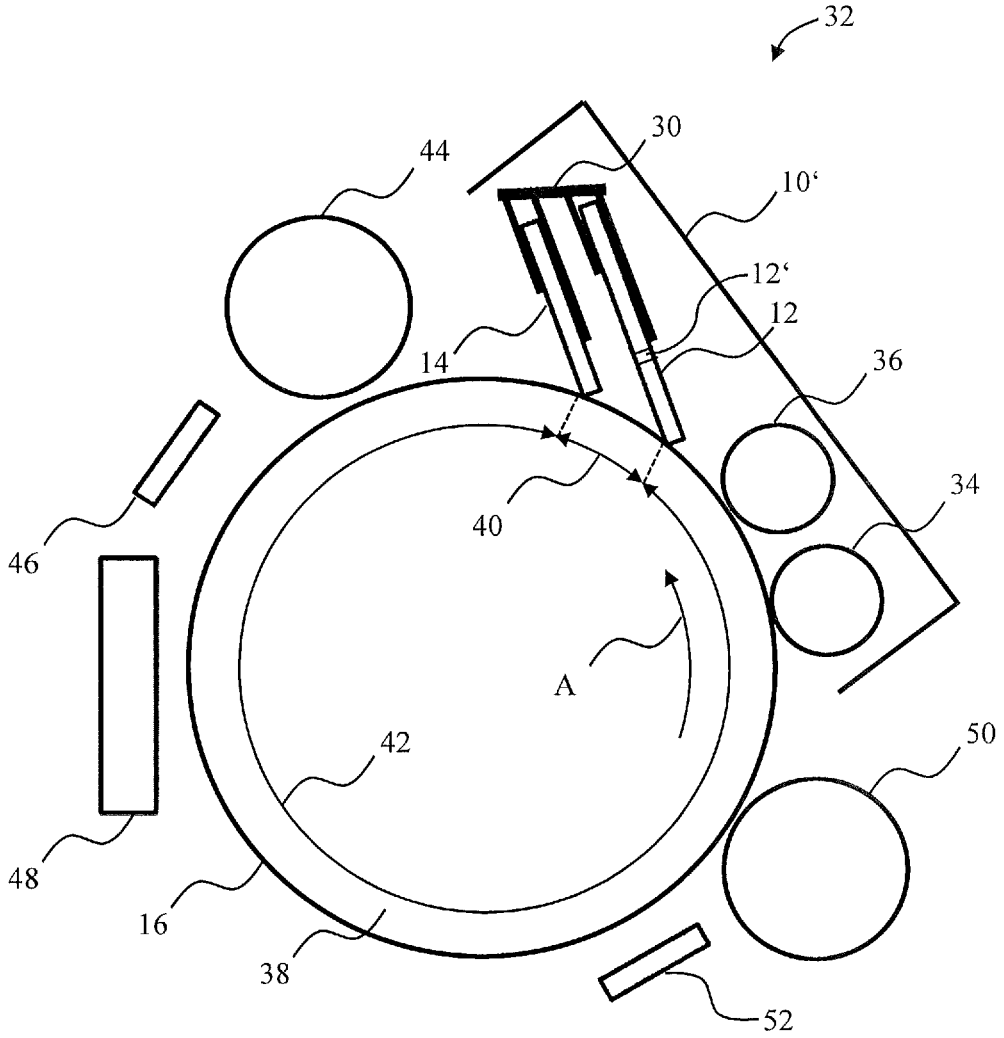
FIG. 2 shows a schematic cross-sectional view of an example of an apparatus comprising a wiping system.

FIG. 2 shows a schematic view of an apparatus 32 comprising a wiping system 10' according to an example. The wiping system 10' comprises the first wiper blade 12 and the second wiper blade 14 described with reference to FIG. 1 mounted to the double wiper support structure 30. At least the first wiper blade 12 may be designed as shown in any of FIGS. 3A to 3F, for example.

Furthermore, the wiping system 10' comprises a first applicator unit 34 and a second applicator unit 36 which may provide a maintenance fluid such as for example imaging oil to the photoconductive surface 16. The photoconductive surface 16 is, for example, formed by a photoconductive foil wrapped around a PIP 38. The PIP may be drum-shaped or may be a transfer member having another shape, such as a belt or other configuration. Furthermore, each of the first applicator unit 34 and the second applicator unit 36 may comprise a sponge applicator that contacts the photoconductive surface 16. The sponge applicators may be used to both apply "fresh" imaging oil to the photoconductive surface 16 and to remove used imaging oil previously applied before applying the fresh imaging oil. Using the sponge applicators 34, 36 imaging oil can be applied such that it will pass just once under the charge roller, as explained blow. Further, the sponge applicator 36 closest to the first wiper blade 12 can collect any imaging oil which passes through the passages 12' in the first wiper blade 12 and feedback the collected imaging oil to an oil application system. Accordingly, oil splashes can be avoided and the excess imaging oil can be reused.

As shown in FIG. 2, the first applicator unit 34 and the second applicator unit 36 may provide the maintenance fluid, such as imaging oil, to the photoconductive surface 16 upstream of the first wiper blade 12 and the second wiper blade 14. In FIG. 2, the movement of the photoconductive surface 16, in this example the rotation direction of the drum-shaped PIP 38, is indicated by arrow A. Because the first applicator unit 34 and the second applicator unit 36 are upstream of both wiper blades, the second wiper blade 14 can wipe the imaging oil wakes and debris that pass the first wiper blade 12.

The apparatus 32 may further comprise a charge roller (CR) 44 for uniformly charging the imaging oil film that has passed the first and second wiper blades 12, 14, and a first discharge device 46 such as, for example, a laser device, for discharging portions of the photoconductive surface 16 charged by the CR 44 to produce latent images. Moreover, the apparatus 32 may comprise a BIDs (binary ink developers) unit 46 for developing ink, i.e., charged liquid toner comprising color particles and imaging oil, to the latent images on the photoconductive surface 16, thereby producing liquid images. Before transferring the liquid images to an ITM 50 (intermediate transfer member), a remaining charge on the photoconductive surface 16 is removed by a second discharge device 52 such as, for example, a set of diodes. On the ITM 50, the fluid images can be cured, for example, by heating and then transferred from the ITM 50 to the print media. Moreover, although a CR 44 is presented herein as a specific example of a charging device, other charging device such as, for example, a scorotron, may be used in the apparatus 32.

After one pass around the photoconductive drum surface and past the charge roller 44, the discharge device 46 and the ITM 50, the imaging oil can be removed by the sponge applicators 34, 36 and fresh imaging oil can be applied.

Figure 4:
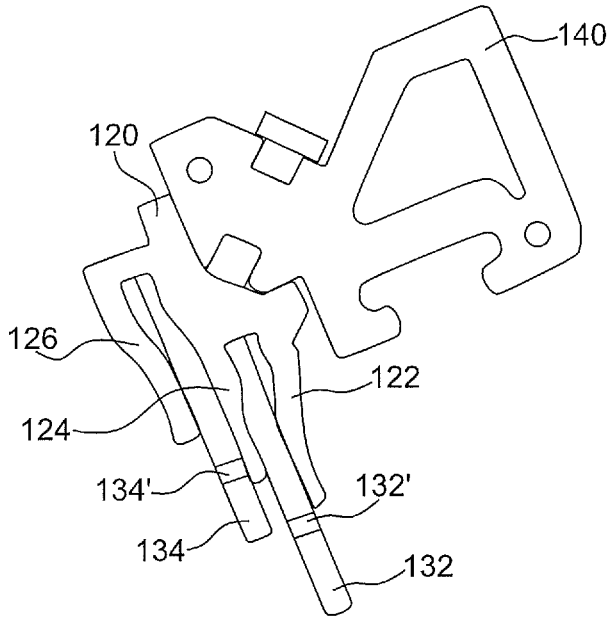
FIG. 4 shows a cross-sectional view of another example of a wiping system.
Figure 5:
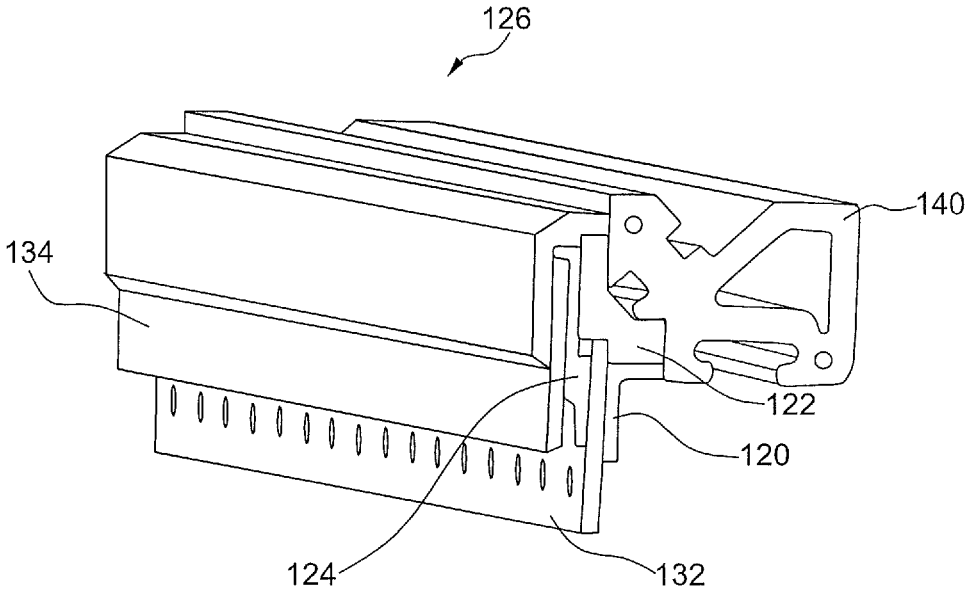
FIG. 5 shows a perspective view of the example of FIG. 4.

FIGS. 4 and 5 show a sectional view and a perspective view of a further example of a wiping system. The example of FIGS. 4 and 5 comprises a holder 120, including three arms 122, 124, 126 for holding a first wiper blade 132 and a second wiper blade 134 therebetween. The holder 120 can be a single piece holder and can be formed by injection molding, as shown in FIG. 4, or it can be assembled from multiple parts, as shown in FIG. 5, for example. In the example of FIGS. 4 and 5, the first wiper blade 132 and the second wiper blade 134 both include a plurality of perforations 132', 134' wherein the perforations 132', 134'can be sized, shaped and arranged as shown e.g. in one of FIGS. 3A to 3F, for example. In the example of FIGS. 4 and 5, the first wiper blade 132 and the second wiper blade 134 are identical wherein the first wiper blade 132 is inserted between the arms 122 and 124 in such a way that the perforation 132' is exposed and the second wiper blade 134 is inserted between the arms 124 and 126 in such a way that the perforation 134' is covered and blocked by the arm 124. Accordingly, the perforation(s) 132' in the first wiper blade form at least one passage through the first wiper blade 132, whereas the second wiper blade 134, when mounted in the holder 120, does not provide passages. If the two wiper blades 132, 134 are formed to be identical, production can be more efficient in that less different parts have to be manufactured and kept track of.

In the example of FIGS. 4 and 5, the holder 120 is attached to an attachment portion 140 for mounting the holder 120 in a predetermined position relative to the photoconductive surface 16, in a printer such as an LEP printer.

FIG. 5 further illustrates an example where the first wiper 122 includes a plurality of equally spaced perforations, wherein the second wiper 124 does not have similar perforations. In another example, the second wiper could have the same perforation pattern as the first wiper but the perforations could be blocked by the intermediate arm 124.

Figure 6:
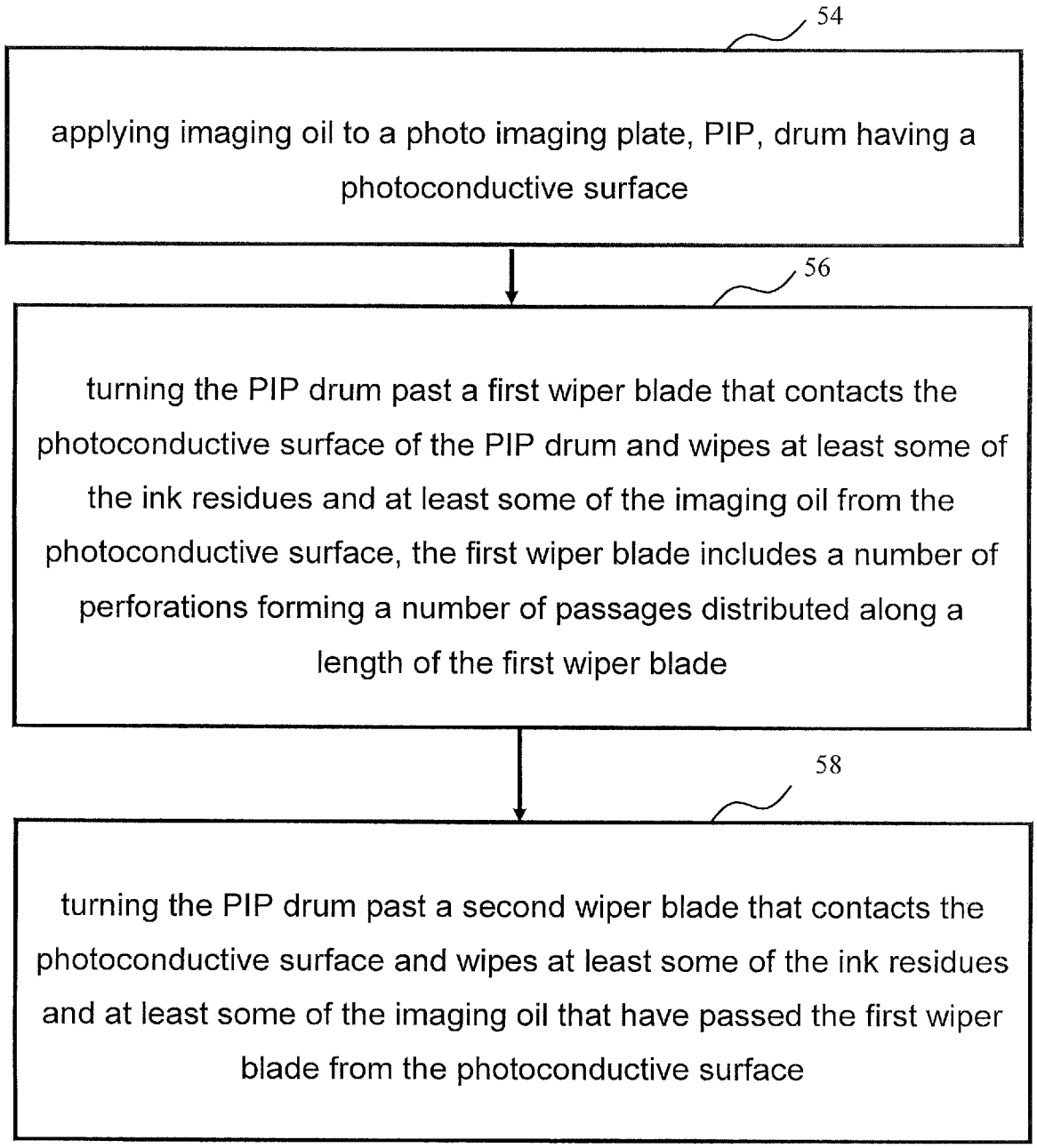
FIG. 6 shows a flow diagram of a process of wiping a photoconductive surface according to an example.

FIG. 6 shows a flow diagram of a process of wiping the photoconductive surface 16 which may, for example, be carried out in apparatus 32. The process starts at 54 with applying, e.g., by the imaging oil applicator units 34, 36, imaging oil to the photoconductive surface 16 of the PIP 38 drum. The process continues at 56 with turning, e.g., by a drive, the PIP 38 drum past the first wiper blade 12 that contacts the photoconductive surface 16 of the PIP 38 drum and wipes at least some of the ink residues and if applicable some of excess imaging oil, e.g. caused by oil wakes, from the photoconductive surface 16. At 58, the PIP 38 is turned past the second wiper blade 14 that contacts the photoconductive surface 16 and wipes at least some of the ink residues and if applicable some of excess imaging oil that have passed the first wiper blade 12 from the photoconductive surface 16.

During wiping of the photoconductive surface using the first wiper blade some of the ink residues, excess imaging oil and particles may pass through the at least one passage formed in the first wiper blade. This particularly may happen when there is an increase of pressure between the two wiper blades and the level of imaging oil rises above a level where it reaches the perforation forming the passage(s). The oil then moves along the path of least resistance which is provided by the passage(s) and reaches the sponge applicator. The wiper configuration hence can avoid splashing of ink residues, imaging oil and particles and an associated contamination of the LEP printing apparatus. For ease of manufacturing, the second wiper blade can be configured in the same way as the first wiper blade. However, as ink residues, and particles should not pass the second wiper blade, any perforation formed in the second wiper blade can be blocked by the associated holder part which, at least at one side of the wiper blade can cover the perforation and hence block any passage.

The invention claimed is:

1. A system for wiping a photoconductive surface, the photoconductive surface moving relative to the system, the system comprising:

at least two wiper blades comprising a first wiper blade and a second wiper blade;

the first wiper blade to contact the photoconductive surface and to wipe at least some of particles and fluid from the photoconductive surface; and the second wiper blade to contact the photoconductive surface and to wipe at least some of the particles and fluid that have passed the first wiper blade, from the photoconductive surface;

wherein the first wiper blade includes at least one perforation forming a passage through the wiper blade;

wherein at least the first wiper blade includes a number of perforations forming a number of passages through the wiper blade and distributed along a width of the first wiper blade, the width of the first wiper blade extending parallel to a contact line between the first wiper blade and the photoconductive surface; and wherein a density of the perforations in at least one side edge region of at least the first wiper blade is higher than in a middle region of at least the first wiper blade wherein the side edge region is adjacent an end of the contact line and the middle region is in the middle between the two ends of the contact line.

2. The system of claim 1 wherein one, two, three, four or five perforations are provided in each side edge region of at least the first wiper blade and no perforations are provided in the middle region of at least the first wiper blade.

3. The system of claim 1 wherein the side edge region extends along about 5% to about 10% of the width of at least the first wiper blade.

4. The system of claim 1 wherein the at least one perforation has a circular, oval or rectangular cross section.

5. The system of claim 1 wherein the second wiper blade is configured in a way identical or substantially identical to the first wiper blade wherein the passages of the second wiper blade are at least partially blocked when the second wiper blade is engaged to the system.

6. The system of claim 5 further including a wiper holder supporting the first and second wiper blades wherein the wiper holder at least partially blocks the passages provided in the second wiper blades.

7. A system for wiping a photoconductive surface, the photoconductive surface moving relative to the system, the system comprising:

at least two wiper blades comprising a first wiper blade and a second wiper blade;

the first wiper blade to contact the photoconductive surface and to wipe at least some of particles and fluid from the photoconductive surface; and the second wiper blade to contact the photoconductive surface and to wipe at least some of the particles and fluid that have passed the first wiper blade, from the photoconductive surface;

wherein the first wiper blade includes at least one perforation forming a passage through the wiper blade;

wherein the at least one perforation has a circular, oval or rectangular cross section; and wherein the at least one perforation is spaced from a front edge of at least the first wiper blade by a distance which is between one time the diameter of the perforation to about four times the diameter of the perforation, wherein the front edge of at least the first wiper blade is the edge facing the photoconductive surface.

8. A system for wiping a photoconductive surface, the photoconductive surface moving relative to the system, the system comprising:

at least two wiper blades comprising a first wiper blade and a second wiper blade;

the first wiper blade to contact the photoconductive surface and to wipe at least some of particles and fluid from the photoconductive surface; and the second wiper blade to contact the photoconductive surface and to wipe at least some of the particles and fluid that have passed the first wiper blade, from the photoconductive surface;

wherein the first wiper blade includes at least one perforation forming a passage through the wiper blade; and wherein the second wiper blade includes at least one perforation forming a passage through the second wiper blade said passage being at least partially blocked.

9. An apparatus comprising a member having a photoconductive surface and a system for wiping the photoconductive surface, the photoconductive surface moving relative to the system, the system comprising:

at least two wiper blades comprising a first wiper blade and a second wiper blade; and a wiper holder supporting the first and second wiper blades; the first wiper blade to contact the photoconductive surface and to wipe at least some of particles and fluid from the photoconductive surface; and the second wiper blade to contact the photoconductive surface and to wipe at least some of the particles and fluid that have passed the first wiper blade, from the photoconductive surface;

wherein the first wiper blade includes a number of perforations forming a number of passages distributed along a width of the first wiper blade, the width of the first wiper blade extending parallel to a contact line between the first wiper blade and the photoconductive surface;

wherein the second wiper blade includes a number of perforations forming a number of passages distributed along a width of the second wiper blade, the width of the second wiper blade extending parallel to a contact line between the second wiper blade and the photoconductive surface; and wherein the passages extend in a direction of relative movement between the wiper blades and the photoconductive surface, and wherein the wiper holder at least partially blocks the passages formed in the second wiper blade and exposes the passages formed in the first wiper blade.

10. The apparatus of claim 9, wherein the fluid is a maintenance fluid and the apparatus further comprises at least one applicator unit to provide the maintenance fluid to the photoconductive surface, wherein the at least one applicator unit is arranged along a movement path of the photoconductive surface upstream of the first and second wiper blades.

11. The apparatus of claim 10, wherein the applicator unit comprises a sponge applicator which is arranged relative to the first wiper blade to direct fluid passing through the passages in the first wiper blade to the sponge applicator.

12. A method of cleaning a photoconductive surface, comprising:

applying imaging oil to a photo imaging plate (PIP) drum having a photoconductive surface;

turning the PIP drum past a first wiper blade that contacts the photoconductive surface of the PIP drum and wipes at least some of ink residues and imaging oil from the photoconductive surface; and turning the PIP drum past a second wiper blade that contacts the photoconductive surface and wipes at least some of the ink residues and imaging oil that have passed the first wiper blade from the photoconductive surface;

wherein the first wiper blade includes at least one passage to transmit part of the ink residues and imaging oil during wiping of the photoconductive surface;

wherein at least the first wiper blade includes a number of passages through the wiper blade distributed along a width of the first wiper blade, the width of the first wiper blade extending parallel to a contact line between the first wiper blade and the photoconductive surface; and wherein a density of the passages in at least one side edge region of at least the first wiper blade is higher than in a middle region of at least the first wiper blade wherein the side edge region is adjacent an end of the contact line and the middle region is in the middle between the two ends of the contact line.

13. The method of claim 12, wherein the first wiper blade includes a plurality of passages distributed parallel to a wiping edge region thereof to transmit part of the ink residues and the imaging oil.

* * * * *